US005643106A

United States Patent [19]

Baird

[11] Patent Number: 5,643,106

[45] Date of Patent: Jul. 1, 1997

[54] GOLF CLUB HEAD

[76] Inventor: William Baird, 2373 N. Linden Rd., Flint, Mich. 48504

[21] Appl. No.: 427,746

[22] Filed: Apr. 24, 1995

[51] Int. Cl.[6] ..... A63B 53/04

[52] U.S. Cl. ..... 473/328; 473/350

[58] Field of Search ..... 273/167 A, 172, 273/174, 169; 473/328, 350

[56] References Cited

U.S. PATENT DOCUMENTS

| | | | |
|---|---|---|---|
| D. 239,964 | 5/1976 | Wilson | D34/5 |
| D. 354,103 | 1/1995 | Allen | D21/214 |
| D. 355,686 | 2/1995 | Hinka | D21/241 |
| 1,531,821 | 3/1925 | Scott | 273/167 A |
| 1,541,126 | 6/1925 | Dunn | 273/167 A |
| 1,673,994 | 6/1928 | Quynn | 273/175 |
| 1,835,718 | 3/1931 | Morton | 273/167 A |
| 2,447,967 | 9/1948 | Stone | 273/77 |
| 3,810,631 | 5/1974 | Braly | 273/167 A |
| 3,862,759 | 1/1975 | Evans et al. | 273/167 A |
| 4,000,902 | 1/1977 | Perkins | 273/167 A X |
| 4,312,509 | 1/1982 | Grant | 273/167 A |
| 4,671,513 | 6/1987 | Swanson | 273/167 A X |
| 5,060,949 | 10/1991 | Brill | 273/167 A |
| 5,456,469 | 10/1995 | Mac Dougall | 273/167 A X |

FOREIGN PATENT DOCUMENTS

| | | | |
|---|---|---|---|
| 455632 | 10/1936 | United Kingdom | 273/167 A |

OTHER PUBLICATIONS

Advertisement From Golf Digest.

*Primary Examiner*—George J. Marlo
*Attorney, Agent, or Firm*—Young & Basile, P.C.

[57] ABSTRACT

A golf club head is disclosed having a body including a striking face and a sole, the sole having a generally double-convex profile defining separate convex bounce surfaces. These convex bounce surfaces provide for decreased frictional drag induced between the ground and the sole of the club head during a typical golf club swing. In a further embodiment, the body of the golf club head includes therein a cavity opposed to the striking face, the cavity opening away from the sole. The cavity of this embodiment is relatively shallow, as the body of the club head is truncated such that only a generally planar region of the body extends therefrom. This planar region includes a portion of the striking face. Accordingly, to this form of the present invention, a club head is provided having optimal weight-balancing and performance characteristics.

5 Claims, 4 Drawing Sheets

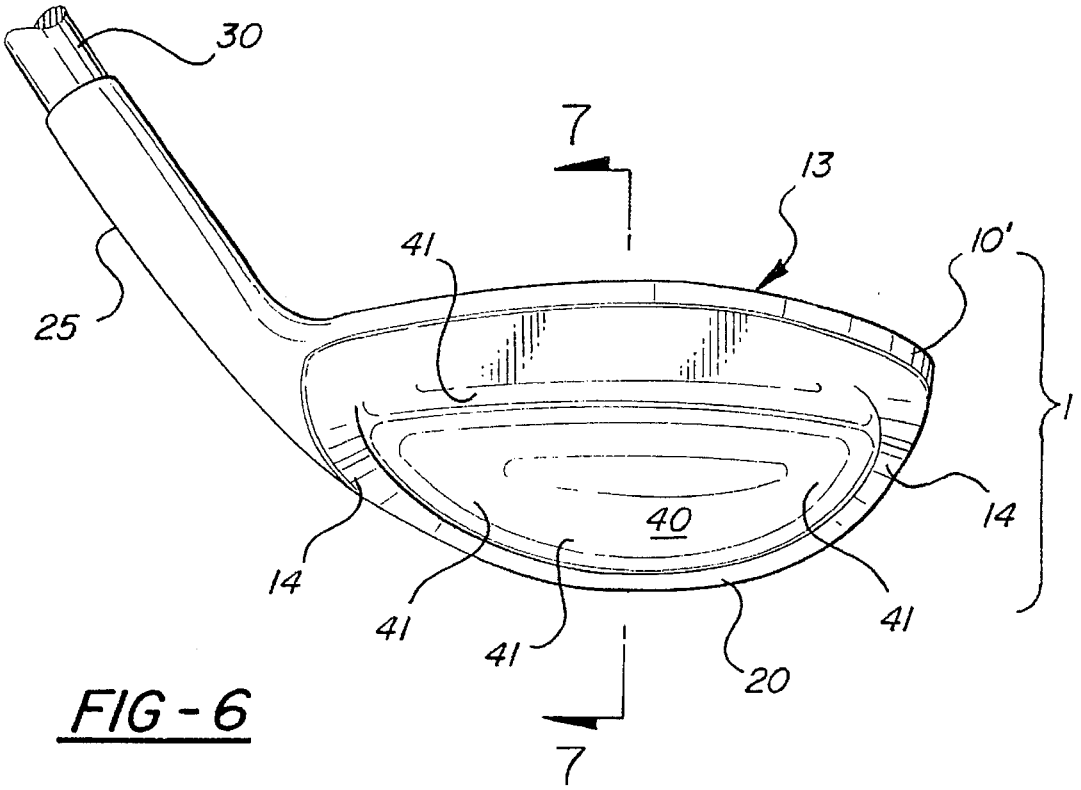
FIG-6
FIG-7
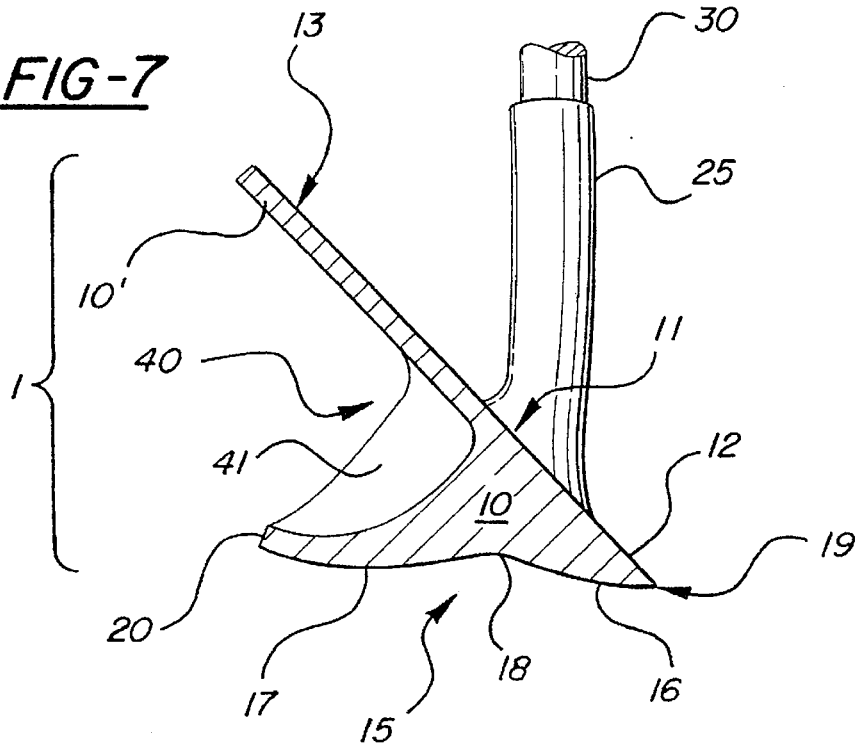

GOLF CLUB HEAD

TECHNICAL FIELD

The present invention relates to golf clubs. In particular, the article of the present invention relates to a golf club head the sole of which has a profile defining a double-convex surface. Each convex region of this surface further defines a separate bounce surface. According to this configuration, the surface area of the sole which contacts the ground at the "bottom" of a typical golf club swing is reduced. This reduced contact surface, or bounce plane, decreases the drag which slows the momentum of a golf club swing Just prior to contact with a ball. In an alternate embodiment of this invention, the club head body includes a cavity oriented behind at least a portion of the striking face of the head. The combination of the cavity and the leading and trailing bounce surfaces in this embodiment provides for a golf club having improved playing characteristics.

BACKGROUND OF THE INVENTION

The overall shape of a golf club head is often dictated by a number of functional considerations, each of which has a bearing on a golf club's performance. One of the most important of such considerations is related to the distribution of a club head's weight in relation to the longitudinal axis of a club shaft.

During the motion of swinging a golf club, the club shaft acts as the radial arm between the center of the swing and the arc defined by the club head. Proper weight distribution of the club head at the end of the shaft is of critical importance during this swinging motion, as it is desirable to achieve a balance which gives the club an "even" feel throughout the swing.

But other less well-recognized considerations also impact golf club performance. For example, the shape of the club head is important during the swing with respect to air flow. A club of radically asymmetrical dimensions or large surfaces may create dissimilarities in air flow, adversely affecting the feel of the club through the swing. And a further functional consideration in club head design is club contact with the ground during the "bottom" portion of the swing.

That portion of the sole of the club head which actually contacts the ground at the "bottom" of the swing is typically referred to as the bounce surface, while the plane of contact defined between the sole and the ground at this point is called the bounce plane. One purpose of the bounce surface is to prevent the rotational force of the swing from driving the club head into the ground as the club head travels through this bounce plane (a phenomenon also referred to as "submarining"). Unfortunately, contact between the bounce surface and the ground has the negative side effect of inducing drag, which slows the momentum of the club head just prior to contact with a golf ball.

Prior art club heads have failed to comprehensively address these considerations. With respect to drag, for example, Stone, U.S. Pat. No. 2,447,967, discloses a golf club having a sole the bounce surface of which comprises a large surface area. And Morton, U.S. Pat. No. 1,835,718, teaches a golf club whose body includes a forwardly curved wing which purposefully induces drag throughout the swing, decreasing a club's momentum.

SUMMARY DISCLOSURE OF THE INVENTION

It is an object of the present invention, therefore, to provide for a golf club head having a bounce surface which preserves swing momentum by reducing the friction between the club sole and the ground.

It is a further object of this invention to provide a golf club head having a shape which improves both the feel and controllability of a golf club throughout the swinging motion.

These and other objects of this invention are achieved through a golf club head whose sole has a profile defining a generally double-convex surface. Each of the two convex regions of this surface further define a separate bounce surface. By means of this double-convex configuration, the surface area of the club sole actually contacting the ground during the "bottom" portion of a swing is reduced.

In one embodiment, each bounce surface is characterized by a generally oblong shape. These bounce surfaces are further oriented parallel with respect to the long axis of the club head body, such that they define leading and trailing bounce surfaces. A channel, disposed between and defined in part by these opposing parallel bounce surfaces, runs along the central longitudinal surface of the club sole.

In yet another embodiment, the leading and trailing bounce surfaces share similar convex profiles. Alternatively, the convex profiles of these bounce surfaces are dissimilar. According to this latter embodiment, the leading bounce surface is characterized by a smaller convex profile.

These and other features of the present invention will be more fully understood with reference to the specification and drawings included herein.

BRIEF DESCRIPTION OF THE FIGURES

FIG. 6 is a rear elevational view of the club head of the present invention, depicting the exposed cavity therein; and FIG. 7 is a cross-sectional side view of the club head of this alternate embodiment, with the shank in the background.

DESCRIPTION OF THE ILLUSTRATED EMBODIMENT

Figure 1:
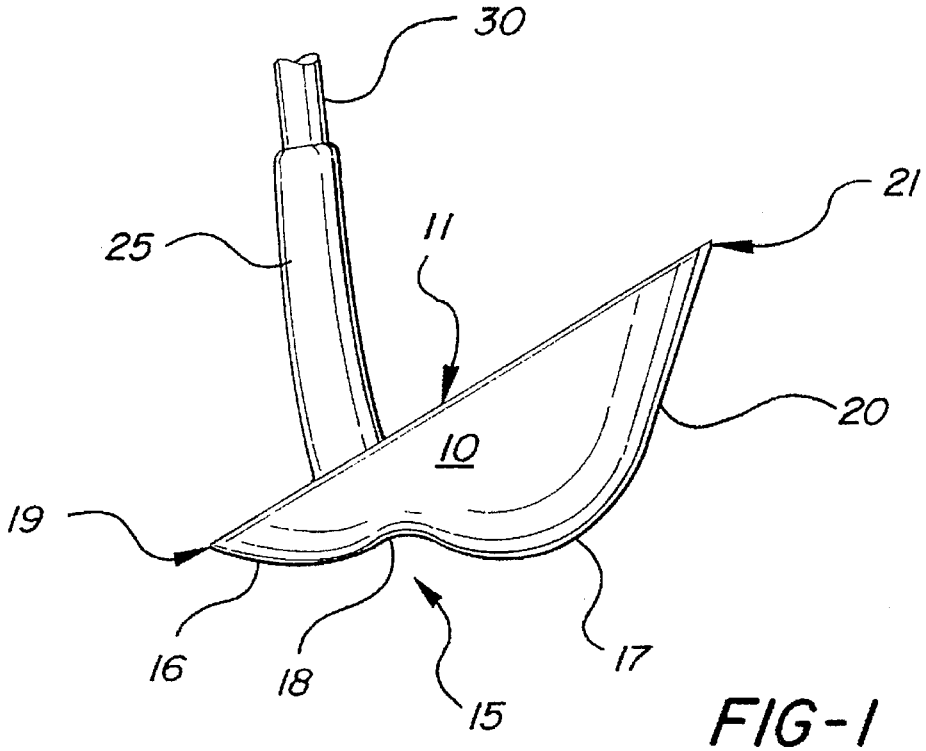
FIG. 1 is a side elevation view of one embodiment of the present invention, with the shank in the background.
Figure 2:
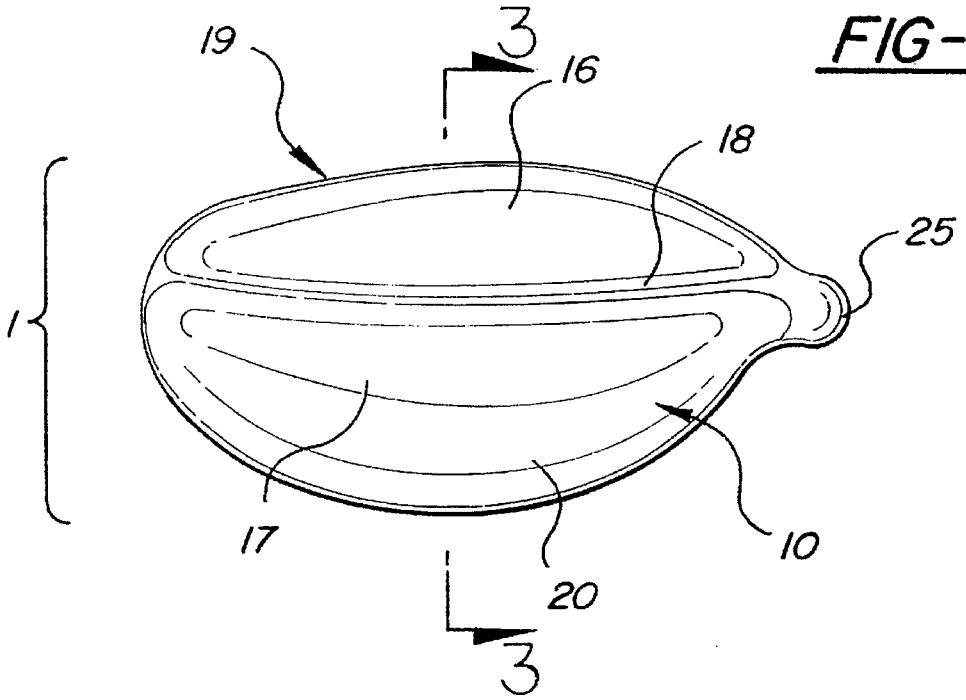
FIG. 2 is a bottom view of the club head of FIG. 1.

Referring to FIGS. 1 and 2, the golf club head 1 of this invention generally comprises a body 10 having both a striking face 11 and a sole 15. As depicted, a hosel or shank 25 is included and radiates from the club body. Shank 25 is generally cylindrical and includes a bore therein for receiving a club shaft 30 (shown here for illustrative purposes). However, alternate methods of affixing a club shaft to device 1 may also be employed, according to user preference. Such known methods include bonding the shaft directly to a bore in the club head, and the like.

Body 10 may be formed from any desired material, including wood, metal, and the like. The body of the illustrated form is fabricated entirely of metal, such as stainless steel, according either to known milling or casting techniques. The overall shape of body 10 is generally that of a wedge, defined by the tapering of the body towards both the club head's leading 19 and trailing 21 edges. But this wedge shape may be modified by increasing or decreasing the angle of the strike face with respect to the longitudinal axis of the club shaft, thereby yielding a club head providing an alternately desired degree of ball loft.

Sole 15 is characterized by a dual-convex surface. Each of the two convex regions of this surface further defines a separate bounce surface 16 and 17. Bounce surfaces 16 and 17 are generally convex and extend across the sole in a desired direction, giving each surface a ridge-like appearance (FIG. 2). In the illustrated embodiment, the bounce surfaces are oriented parallel with respect to the long axis of the club head body 10, so as to define a lateral double-convex profile having leading 16 and trailing 17 bounce surfaces (FIG. 2). Leading bounce surface 16 is disposed proximate the leading edge 19 of the club head, while trailing bounce surface 17 is disposed proximate the club head's trailing edge 21. Alternately, bounce surfaces 16 and 17 may be oriented in any direction with respect to the long axis of the club head, thus varying the profile of the sole from the illustrated lateral, double-convex embodiment. And while two such bounce surfaces of the described orientation are preferred for both weight-balancing and contact characteristics, as explained further herein, any number of such bounce surfaces may be included, subject to the limitations set forth herein.

Interposed between each convex region is channel 18. The channel runs between and parallel to both bounce surfaces 16 and 17, which define its lateral sides. As explained in greater detail below, the depth and width of channel 18 (and relatedly, the height of each convex bounce surface) define an area of sole 15 which does not contact the ground during a golf swing, thereby preserving the momentum of the swing.

Figure 3:
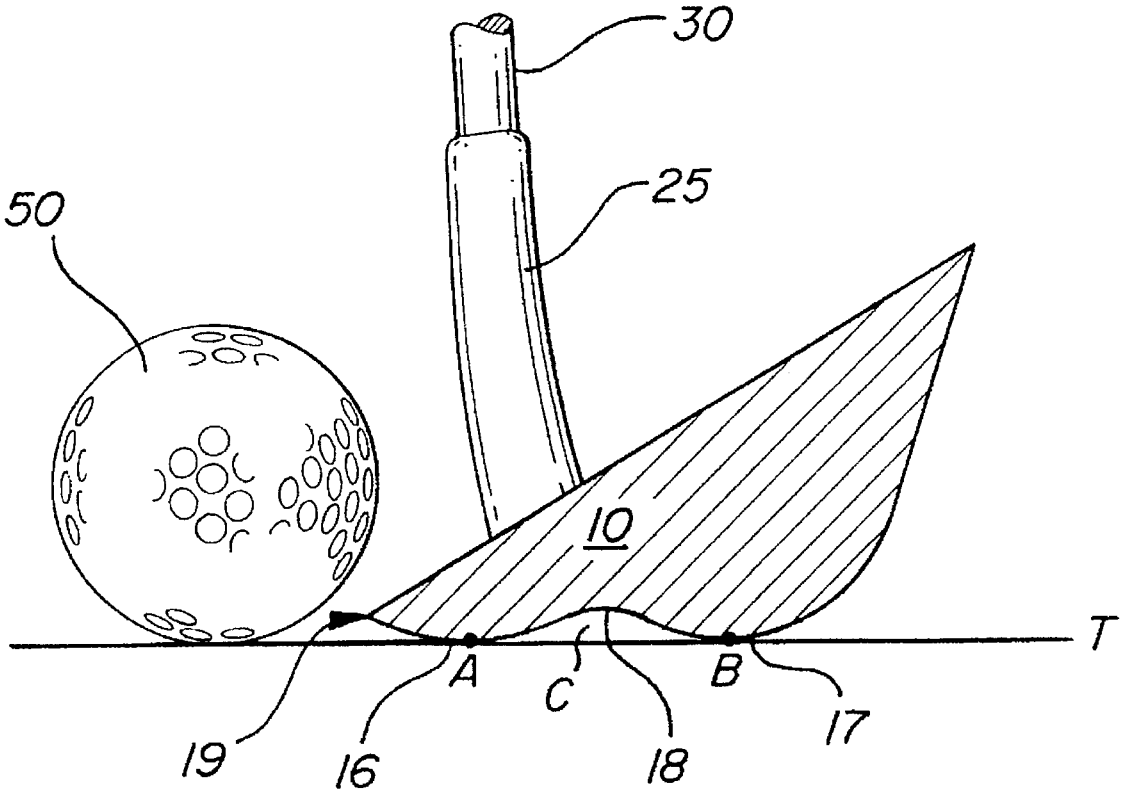
FIG. 3 is a cross-sectional representation of the club head of FIGS. 1 and 2.
Figure 4:
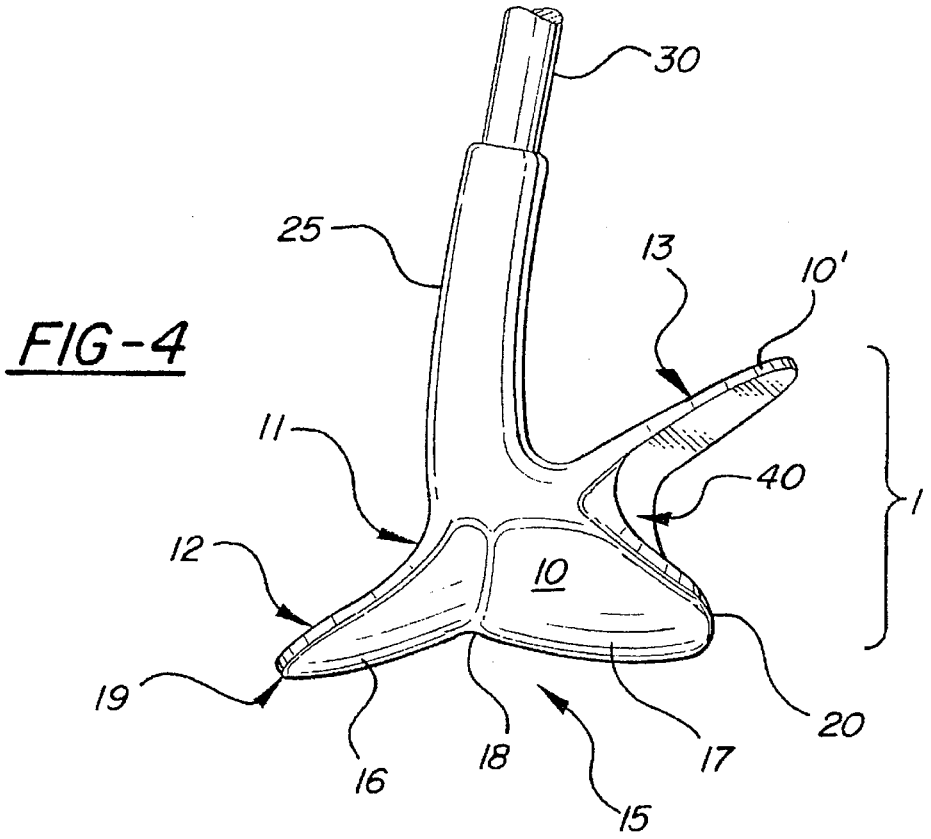
FIG. 4 is a perspective side-view of an alternative embodiment of the present invention, with the shank in the foreground.
Figure 5:
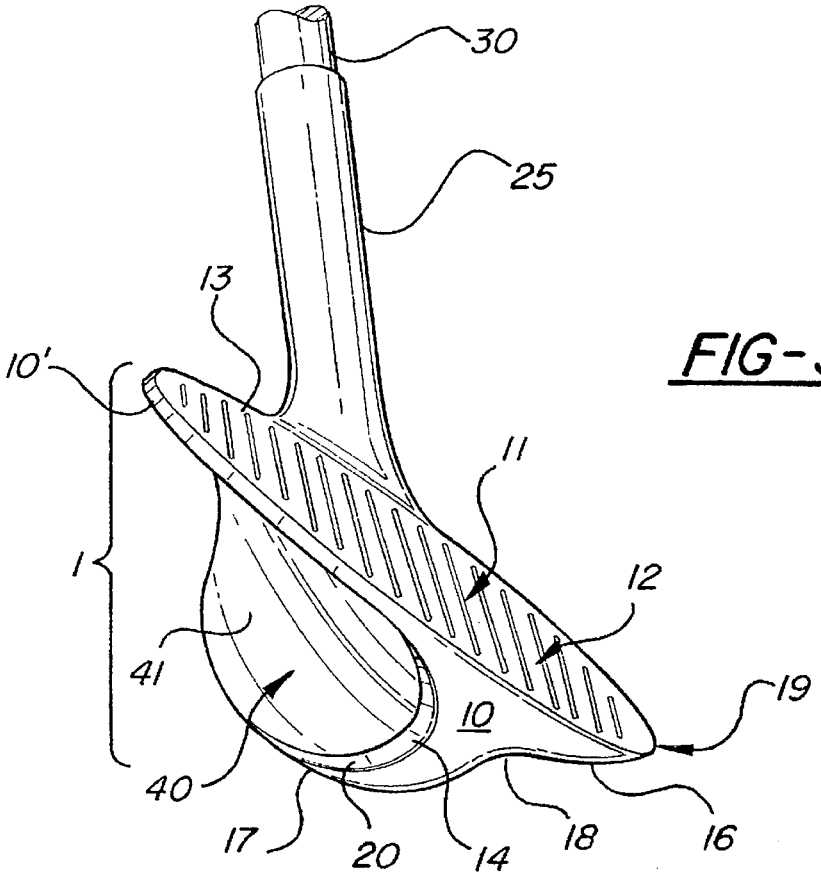
FIG. 5 is a perspective view of the club head of the embodiment of FIG. 4, with the shank shown in the background.

As shown in FIG. 3, each separate, generally convex bounce surface 16 and 17 of sole 15 defines a single bounce plane (identified by the intersection of line T and points A and B). This plane represents club sole contact with the ground (represented by horizontal line T) at the very bottom portion of a typical swinging motion. During the typical golf club swinging motion, the arc defined by the club head will intersect the ground, bringing the sole in contact therewith. The greatest contact usually occurs along this bounce plane at the "bottom" of the swing, just prior to the club head's striking a golf ball 50. Common club heads are typified by flat sole surfaces which create a large surface area and, consequently, substantially continuous contact between the sole and the ground. In contrast, the increased surface area of sole 15 created by the double-convex profile actually serves to decrease contact between the club head and the ground along the bounce plane. As can be seen, club sole contact is limited generally to points A and B along each convex bounce surface, while the area C therebetween induces no drag.

It will be thus appreciated that the illustrated embodiment of this device serves to minimize reductions in swing momentum caused by drag induced between the bounce surfaces of the club sole and the ground. However, these results need not be limited to the illustrated form.

As depicted, the convex bounce surfaces have dissimilar convex profiles; leading bounce surface 16 being slightly smaller than trailing bounce surface 17 in overall appearance. But this profile is due to the shape of body 10 which is, in turn, dictated by the angle of striking face 11 and weight-balancing considerations generally. Thus, the double-convex profile of sole 15 can be endlessly varied according to user preference, club function, and other considerations similar to those described herein, without departing from the benefits of the separate convex bounce surfaces so described. A double-convex sole wherein each bounce surface has a similar profile, for example, would just as readily provide the decreased drag functions of the illustrated embodiment. Similarly, the number of bounce surfaces may be altered. However, two convex bounce surfaces of the illustrated size and orientation are preferred as they facilitate a smooth golf club swinging motion as the club sole traverses the bounce plane.

Referring now to FIGS. 4 through 7, an alternate embodiment of the present invention is depicted. Like the club head in FIGS. 1 through 3, club head 1 of this embodiment includes a body 10 having both a striking surface 11 and a sole 15 with leading and trailing bounce surfaces 16 and 17, respectively. A shank 25 is also included and a portion of a golf club shaft 30 protruding therefrom is illustrated. As with the foregoing embodiment, however, neither the shank nor the club shaft are integral to the present invention.

Unlike the previous embodiment, the club head of FIGS. 4 through 7 includes a body 10 in which is disposed an exposed cavity 40 defined by interior walls 41. In the illustrated form, body 10 has the further characteristic of being substantially truncated rearward from the trailing bounce surface 17; with only a generally planar region 10' of the body extending there beyond. This planar region includes an upper portion 13 of striking face 1t, as illustrated. According to this preferred configuration, the weight of the club head is distributed more proximate the leading edge of body 10, resulting in an improved club "feel". The club head of this embodiment, including the combination of cavity 40 and truncated body 10, also reduces the overall weight of the club head by approximately 40% over a similar club head lacking either a cavity or a truncated rear half. But while this truncated form is preferred for its improved weight-balancing and drag reducing benefits, the body of this invention need not be truncated. Instead, cavity 40 may also be included in a full-sized body of the type shown in FIGS. 1 through 3.

Referring to FIGS. 6 and 7, it can be seen that cavity 40 is opposed to striking face 11, opening away from sole 15. Preferably, the cavity extends the principal length of club head body 10 and has a generally oblong shape. As illustrated, the width of the cavity does not increase proportionally in relation to the increasing width of body 10 towards striking face 11. Instead, the lateral portions 14 of the body are characterized by an upwardly increasing thickness. This configuration is preferred for both its weight-balancing characteristics and the structural rigidity imparted to striking face 11 by the upwardly increasing thickness of lateral portions 14. However, cavity 40 need not assume these oblong dimensions and any desired cavity shape which opens away from sole 15 may be substituted therefor.

As shown in FIG. 7 which represents a lateral cross-sectional of the club head of FIG. 6 taken along line VII through VII, the depth of cavity 40 is defined in part by its volume; a cavity of the illustrated asymmetrical cross-section occupying approximately 40% of the area of truncated body 10. In a cavity of this cross-section, the depth is further defined by the decreasing thickness of body 10 as it tapers toward trailing edge 20 (FIG. 7). Of course, the depth of cavity 40 is also variable, depending upon club head weight-balancing considerations and the overall shape desired for the club head body. As such, any depth and corresponding thickness of body 10 are possible according to user preference.

Of course, it is understood that the foregoing embodiments are illustrative only. Numerous changes and modifications, apparent to those having ordinary skill in the art, can be made without departing from the spirit and broader aspects of the present invention, as defined in the appended claims.

The article in which an exclusive property or privilege is claimed is defined as follows:

I claim:

1. A drag-reducing golf club head, comprising a body including both a striking face and a sole, said sole having at least one recessed channel disposed therein and oriented approximately parallel to the longitudinal axis of said club heads, said channel separating at least first and second downwardly facing bounce surfaces extending across the principal surface of said sole and disposed approximately parallel with respect to each other to define along a lateral cross-section of said golf club head a double-convex profile said bounce surfaces each being approximately parallel to the longitudinal axis of said club head and having a greater cross-sectional area than said channel, said bounce surfaces further defining a significantly reduced area of contact between said sole and a fixed plane of reference tangential to a point on each of said at least first and second bounce surfaces such that contact between said sole and said fixed plane of reference is reduced as said club head moves through an arc to which said fixed plane of reference is tangential.

2. The golf club head of claim 1, wherein said bounce surfaces are characterized by similar cross-sectional widths.

3. The golf club head of claim 1, wherein said bounce surfaces are characterized by dissimilar cross-sectional widths.

4. The golf club head of either claim 2 or claim 3, wherein said bounce surfaces extend across the principal surface of said sole.

5. A drag-reducing golf club head comprising a body including both a striking face and a sole, said sole having a recessed channel disposed approximately intermediately therein and oriented approximately parallel to the longitudinal axis of said club head, said channel separating leading and trailing downwardly facing bounce surfaces extending across the principal surface of said sole and disposed approximately parallel with respect to each other and defining along a lateral cross-section of said golf club head a double-convex profile said bounce surfaces each having a cross-sectional area greater than that of said channel and being both coextensive with and approximately parallel to the longitudinal axis of said club head, wherein said leading bounce surface is characterized by a narrower cross-sectional width than said trailing bounce surface, and wherein further said bounce surfaces define a significantly reduced area of contact between said sole and a fixed plane of reference tangential to a point on each of said first and second bounce surfaces such that contact between said sole and said plane of reference is reduced as said club head moves through an arc to which said fixed plane of reference is tangential.

* * * * *